US005836019A

United States Patent [19]

McCafferty

[11] Patent Number: 5,836,019

[45] Date of Patent: Nov. 17, 1998

[54] SOCK WITH HIDDEN POCKET

[76] Inventor: Marilyn E. McCafferty, 1400 Vernier, Grosse Pointe Woods, Mich. 48236

[21] Appl. No.: 988,464

[22] Filed: Dec. 10, 1997

[51] Int. Cl.[6] ..... A41B 11/00

[52] U.S. Cl. ..... 2/239; 2/247

[58] Field of Search ..... 2/239, 247, 248, 2/250, 254, 242, 61; 66/178 R, 183, 188

[56] References Cited

U.S. PATENT DOCUMENTS

| | | | |
|---|---|---|---|
| 767,381 | 8/1904 | Brown | 2/239 |
| 1,025,643 | 5/1912 | Presmont | 2/239 |
| 1,117,591 | 11/1914 | Morningstar | 2/239 |
| 1,257,643 | 2/1918 | Smith | 2/239 |
| 1,878,865 | 9/1932 | Largman | 2/239 |
| 2,814,807 | 12/1957 | Dollar | 2/239 |
| 2,890,461 | 6/1959 | Hartman et al. . | |
| 4,005,494 | 2/1977 | Burn . | |
| 4,445,233 | 5/1984 | Rubin . | |
| 4,630,455 | 12/1986 | Lingenfelter | 2/239 |
| 4,961,235 | 10/1990 | Williger . | |
| 5,027,440 | 7/1991 | Morris et al. . | |
| 5,067,177 | 11/1991 | Binder | 2/239 |
| 5,125,117 | 6/1992 | Buenos et al. . | |
| 5,133,091 | 7/1992 | del Valle Mas . | |
| 5,157,791 | 10/1992 | Woodson et al. | 2/239 |
| 5,625,904 | 5/1997 | Kline . | |
| 5,651,142 | 7/1997 | del Valle Mas . | |
| 5,655,226 | 8/1997 | Williams | 2/239 |
| 5,664,263 | 9/1997 | Reynolds . | |
| 5,675,992 | 10/1997 | Wrightenberry | 2/239 |
| 5,682,616 | 11/1997 | Pisano | 2/239 |

*Primary Examiner*—Amy Vanatta
*Attorney, Agent, or Firm*—Peter D. Keefe

[57] ABSTRACT

A sock having a neck featuring an internal pocket, wherein the sock is completely normal in appearance and requires no unusual manipulations. A generally conventional sock body is composed of a neck portion and a foot portion, wherein the neck portion is preferably composed of a stretchable fabric for elastically engaging the wearer's leg. An inner neck member is connected with the neck portion by a sewing seam, preferably at the demarcation between the neck and foot portions of the sock body, thereby forming an annular pocket. The inner neck member is preferably composed of the same material and has the same appearance as that of the neck portion. The neck portion terminates remote from the foot portion at am outer mouth. The inner neck member terminates remote from its connection to the neck portion at an inner mouth, wherein the inner mouth is located within the neck portion. One or more articles may be inserted into the annular pocket anywhere around the circumference of the neck portion.

8 Claims, 1 Drawing Sheet

SOCK WITH HIDDEN POCKET

BACKGROUND OF THE INVENTION

1. Field of the Invention

The present invention relates to socks, and more particularly to socks having pockets for holding objects thereinside. Still more particularly, the present invention relates to a sock having a pocket unobtrusively formed of coaxially disposed inner and outer necks.

2. Description of the Prior Art

There are a number of occasions when a person desires to carry one or more objects, but either the person does not have pockets, or does not wish to use his or her pockets for this purpose. For example, increasingly popular athletic clothing articles usually do not feature pockets. Further for example, a traveler in a foreign country may be concerned that valuables carried in a pocket may be easily stolen. Still further for example, a parent may worry that his or her child may loose lunch money if carried in a pocket, or maybe that a bully might steal it.

One solution to providing an extra storage location other than a pocket is to wear a pouch at the waist. Some pouches are designed to be visible and worn outside regular clothing, while others are designed to be hidden and worn beneath clothing. In any event, the disadvantage of these products is that they are an extra accessory which must be worn in addition to regular clothing.

Accordingly, what is needed is a piece of regular clothing which can serve as a location for a hidden pocket.

In the prior art, several inventors have proposed placing a pocket in the neck of a sock.

For example, U.S. Pat. Nos. 5,664,263; 5,625,904; 5,027,440; 4,961,235; 4,445,233; 4,005,494; and 2,890,461 generally describe sock necks having pockets which are either external to the neck, or internal to the neck with an opening through the neck for the wearer to access the pocket. Such pocketed socks have the disadvantage of being easily detected by an onlooker, and are, therefore, undesirable for both aesthetic and stealth reasons.

Further for example, U.S. Pat. Nos. 5,651,142 and 5,133,091 describe sock necks having a pocket, wherein at least a portion of the neck is rolled down to thereby conceal the pocket. Such pocketed socks suffer from the disadvantage of needing a manipulation of the sock neck which is uncustomary, and likely will result in a noticeable difference in appearance between such a pocketed sock and a regular sock.

Accordingly, what remains needed in the art is a sock having an internal pocket whereby the sock is completely normal in appearance and requires no unusual manipulations.

SUMMARY OF THE INVENTION

The present invention is a sock having a neck featuring an internal pocket, wherein the sock is completely normal in appearance and requires no unusual manipulations.

The sock according to the present invention includes a generally conventional sock body composed of a neck portion and a foot portion, wherein the neck portion is preferably composed of a stretchable fabric for elastically engaging the wearer's leg. An inner neck member is connected with the neck portion by a sewing seam, preferably at the demarcation between the neck and foot portions of the sock body. The inner neck member is preferably composed of the same material, and has the same appearance, as that of the neck portion. The neck portion terminates remote from the foot portion at an outer mouth. The inner neck member terminates remote from its connection to the neck portion at an inner mouth, wherein the: inner mouth is located within the neck portion.

In operation, a wearer places his or her foot into the inner and outer mouths so that the wearer's foot passes receivably into the foot portion. The wearer then adjusts the inner neck member and the neck portion on his or her calf for a comfortable placement, wherein the inner neck member is completely occluded by the neck portion (that is, the outer mouth is higher up the wearer's leg than is the inner mouth). Now, anyone looking at the wearer's socks would only appreciate normalcy in appearance and never suspect that the socks were anything other than conventionally constructed.

The wearer may now place one or more articles, such as for example money, credit cards, passports, etc. into the annular pocket formed between the inner neck member and the neck portion. The articles will settle into the annular pocket, but not pass out of the seam connection between the inner neck member and the neck portion. It will be understood, therefore, that what is provided is an annular pocket, wherein the wearer may conveniently choose to place an article therein anywhere around the circumference of his or her leg.

Accordingly, it is an object of the present invention to provide a sock having a truly hidden pocket for holding articles therewithin.

It is another object of the present invention to provide a sock having an annular pocket.

It is yet a further object of the present invention to provide a sock having an annular pocket formed between coaxially arranged necks.

These, and additional objects, advantages, features and benefits of the present invention will become apparent from the following specification.

DETAILED DESCRIPTION OF THE PREFERRED EMBODIMENT

Figure 1:
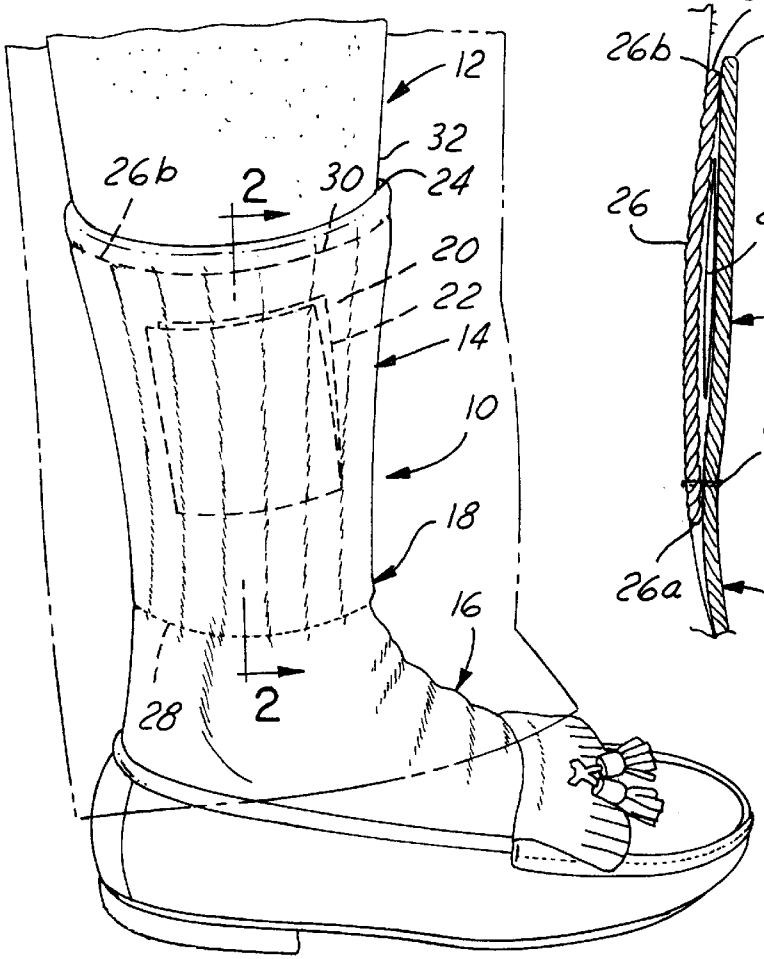
FIG. 1 is a perspective view of the sock according to the present invention, shown in operation being worn by a wearer.

Referring now to the Drawing, FIG. 1 depicts a sock 10 according to the present invention, wherein it will be appreciated that the external appearance of the sock to an onlooker is the same as that of a conventional sock. In addition, it will be appreciated that the wearer 12 is wearing the sock 10 comfortably and in a conventional manner.

The sock 10 is composed of a neck portion 14 and a foot portion 16, wherein the foot and neck portions are integrally connected or sewn together in a conventional manner so as to provide a conventionally looking sock body 18.

Figure 4:
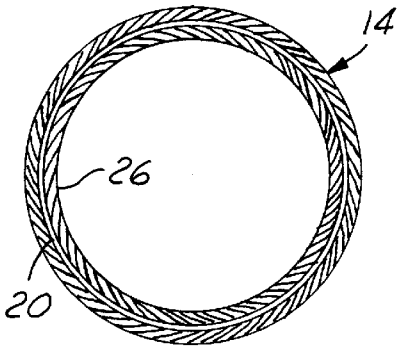
FIG. 4 is a sectional view of the sock according to the present invention, seen along line 4—4 in FIG. 3.

However, even though the sock 10 appears conventional, it is not, in that it includes an annular pocket 20 (see FIG. 4)

formed interiorly with respect to the neck portion 14. The annular pocket 20 serves to unobtrusively retain thereinside one or more articles, such as paper money 22.

Figure 3:
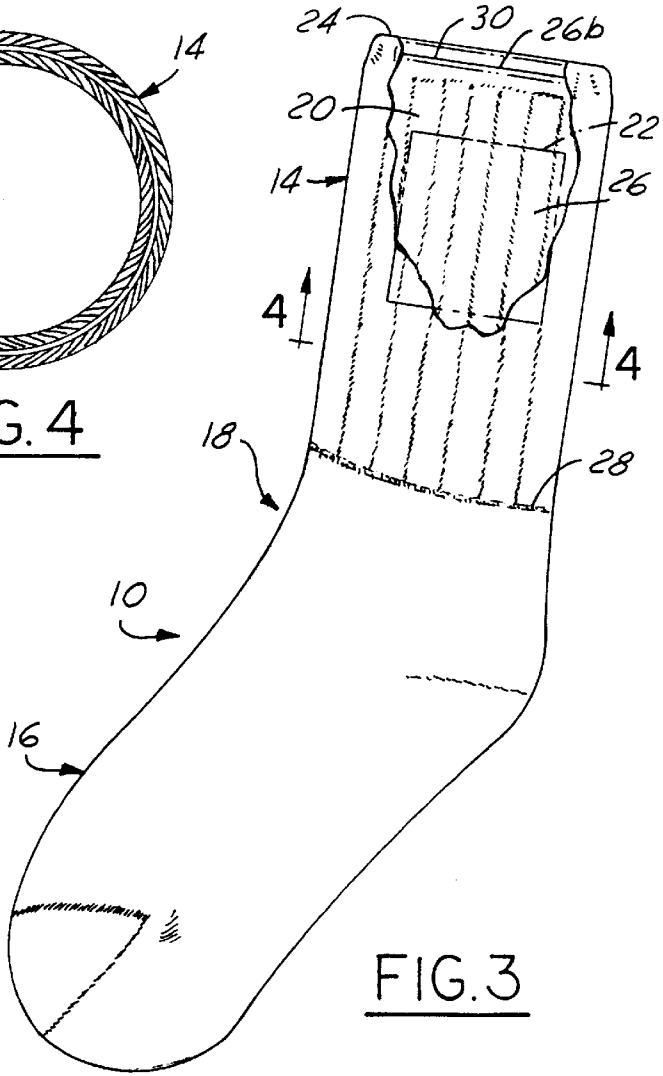
FIG. 3 is a partly broken away side view of the sock according to the present invention.
Figure 2:
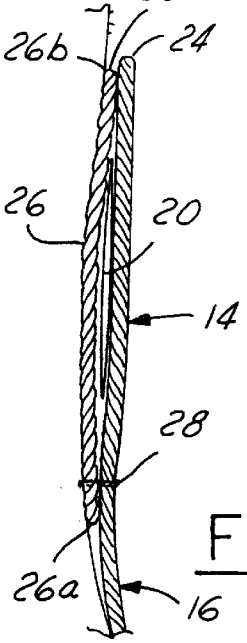
FIG. 2 is a sectional side view of the sock according to the present invention, seen along line 2—2 in FIG. 1.

The structure and function of the sock 10, including the annular pocket 20 there, will now be detailed with greater specificity with additional reference to FIGS. 2 through 4.

The neck and foot portions 14, 16 are preferred to be composed of conventional sock materials, although any sock suitable material may be used. In this regard, it is preferred for the neck portion 14 to have elasticity so as to hug the wearer's calf. Preferably, an elastic band area woven conventionally into the fabric of the neck portion near the outer mouth 24 thereof.

An inner neck member 26 is located coaxially with respect to the neck portion 14. The inner neck member 26 is preferably composed of the same material and preferably has the same appearance as the neck portion 14. The inner neck member 26 is connected at or near a first end 26*a* thereof to the neck portion by a sewed seam 28. Preferably, the seam 28 is located unobtrusively at a demarcation between the foot and neck portions 14, 16 (as seen at FIGS. 1 and 3). Remote from the first end 26*a* is an opposite second end 26*b* of the inner sock member 26.

As shown best at FIG. 3, the second end 26*b* of the inner neck member 26 forms an inner mouth 30. The inner mouth 30 is preferably disposed within the outer neck portion 14. In this regard, the inner neck member 26 extends a first distance between the seam 28 and the inner mouth 30, while the neck portion extends a second distance between the seam and the outer mouth 24, wherein the second distance exceeds the first distance.

As best shown by comparative examination of FIGS. 2 and 4, the spacing between the inner neck member 26 and the neck portion 14 forms the aforementioned annular pocket 20 situated between the seam 28 and the inner mouth 30. In this regard, as can best be appreciated by FIG. 4, an article or articles may be receivably inserted into the annular pocket 20 anywhere around the circumference of the neck portion.

In operation, a wearer 12 places his or her foot into the inner and outer mouths 30, 24 so that the wearer's foot passes receivably into the foot portion 16. The wearer then adjusts the inner neck member 26 and the neck portion 14 on his or her calf 32 for a comfortable placement, wherein the inner neck member is completely occluded by the neck portion (that is, the outer mouth is higher up the wearer's leg is the inner mouth). Now, anyone looking at the socks would only appreciate normalcy in appearance and never suspect the socks were anything other than conventionally constructed.

The wearer may now place one or more articles, such as for example money, credit cards, passports, keys, etc. into the annular pocket formed between the inner neck member and the neck portion. This is achieved by grasping the neck portion at the outer mouth and pulling laterally away from the calf at the location the article is desired to be placed. The article or articles will settle into the annular pocket, but be retained therein by the seam 28. It will be understood, therefore, that what is provided is an annular pocket, wherein the wearer may conveniently choose to place an article therein anywhere around the circumference of his or her leg.

It is most preferred to utilize the inherent elasticity of the neck portion 14 adjacent the outer mouth 24 to cause an article to be retained inside the annular pocket even during strenuous activity, such as running. If needed, a hook and loop fastener, such as for example a product of this kind known as VELCRO (trademark of Velcro USA), may be suitably placed between the neck portion and the inner neck member adjacent the inner mouth.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A sock having a pocket comprising:

a sock body comprising:

a foot portion for receiving therein a foot of a person; and a neck portion connected to said foot portion for engaging a calf of the person; and an inner neck member coaxially disposed in relation to said neck portion, said inner neck member having a first end and an opposite second end, said inner neck member being connected to said sock body at an annular connection substantially adjacent said first end;

wherein a space between said neck portion and said inner neck member comprises an undivided annular pocket extending between said annular connection and said second end; and wherein said neck portion terminates remote from said foot portion at an outer mouth; wherein said inner neck member extends a first distance between said annular connection and said second end, and wherein said neck portion extends a second distance between said annular connection and said outer mouth, wherein said second distance exceeds said first distance.

2. The sock of claim 1, wherein said neck portion is composed of a predetermined material having a predetermined appearance, and wherein said inner neck member is composed of said predetermined material and has said predetermined appearance.

3. The sock of claim 2, wherein said neck portion has elasticity.

4. The sock of claim 3, wherein said elasticity is operative adjacent said outer mouth.

5. A sock having an annular pocket comprising:

a sock body comprising:

a foot portion for receiving therein a foot of a person; and a neck portion connected to said foot portion for engaging a calf of the person; and an inner neck member coaxially disposed in relation to said neck portion, said inner neck member having a first end and an opposite second end, said inner neck member being connected to said sock body at an annular connection substantially adjacent said first end;

wherein a space between said neck portion and said inner neck member comprises an annular pocket extending between said annular connection and said second end;

wherein said neck, portion terminates remote from said foot portion at an outer mouth; wherein said inner neck member extends a first distance between said annular connection and said second end, and wherein said neck portion extends a second distance between said annular connection and said outer mouth, wherein said second distance exceeds said first distance; and wherein said second end of said inner neck member is separable from said neck portion to thereby open said pocket for placing at least one selected article into said pocket.

6. The sock of claim 5, wherein said neck portion is composed of a predetermined material having a predetermined appearance, and wherein said inner neck member is composed of said predetermined material and has said predetermined appearance.

7. The sock of claim 6, wherein said neck portion has elasticity.

8. The sock of claim 7, wherein said elasticity is operative adjacent said outer mouth.

* * * * *